US006286171B1

(12) United States Patent
Sztymelski

(10) Patent No.: US 6,286,171 B1
(45) Date of Patent: Sep. 11, 2001

(54) APPARATUS FOR REMOVING DEBRIS FROM A MACHINED OR THREADED CAVITY

(76) Inventor: Andrew Sztymelski, 3901 Cross St., Eugene, OR (US) 97402

( * ) Notice: Subject to any disclaimer, the term of this patent is extended or adjusted under 35 U.S.C. 154(b) by 0 days.

(21) Appl. No.: 09/393,447

(22) Filed: Sep. 10, 1999

Related U.S. Application Data

(60) Provisional application No. 60/101,394, filed on Sep. 22, 1998.

(51) Int. Cl.[7] ..... B08B 1/00; B08B 9/00

(52) U.S. Cl. ..... 15/104.001; 15/104.03; 15/104.05; 29/81.029; 294/61

(58) Field of Search ..... 15/104.001, 104.03, 15/104.05, 104.32, 104.16, 104.31, 104.33; 81/436, 441; 29/81.021; 294/5, 61, 121

(56) References Cited

U.S. PATENT DOCUMENTS

| | | | | |
|---|---|---|---|---|
| 801,759 | * | 10/1905 | Woolldridge et al. | 15/104.33 |
| 1,215,461 | * | 2/1917 | Woolhiser | 15/104.33 |
| 1,568,094 | * | 1/1926 | Shelburne | 15/104.05 |
| 1,653,995 | * | 12/1927 | English | 15/104.33 X |
| 1,758,504 | * | 5/1930 | English | 15/104.33 X |
| 1,845,442 | * | 2/1932 | Robinson | 15/104.33 |
| 2,066,598 | * | 1/1937 | Wiessner | 15/103.33 X |
| 5,070,568 | * | 12/1991 | Wilcox et al. | 15/104.05 X |

FOREIGN PATENT DOCUMENTS

| | | | | |
|---|---|---|---|---|
| 457821 | * | 9/1916 | (FR) | 15/104.31 |
| 2479035 | * | 10/1981 | (FR) | 15/104.05 |
| 2244641 | * | 12/1991 | (GB) | 15/104.03 |
| 1537328 | * | 1/1990 | (SU) | 15/104.03 |

* cited by examiner

*Primary Examiner*—Mark Spisich
(74) *Attorney, Agent, or Firm*—Steven J. Adamson

(57) ABSTRACT

An apparatus for extracting debris from a machined or threaded cavity. The apparatus may include an extraction member formed at least in part as a coil region and a control region, the coiled region being controlled by the control region while in a cavity. The control region may have a releasable handle attached to it and that handle may contain a cavity for storing one or more extraction members of different size. The extraction member is preferably formed of a continuous wire and has a specially formed extraction tip.

14 Claims, 1 Drawing Sheet

APPARATUS FOR REMOVING DEBRIS FROM A MACHINED OR THREADED CAVITY

CROSS REFERENCE TO RELATED APPLICATIONS

This application claims the benefit of U.S. Provisional Application No. 60/101,394, filed Sep. 22, 1998, and having the same title and inventor(s) as above.

FIELD OF THE INVENTION

The present invention relates to a device for removing debris from a threaded or otherwise machined cavity. The present invention is particularly well suited for use with metallic or like substances, but is also applicable to wood, plastics and other materials.

BACKGROUND OF THE INVENTION

Machine techniques for creating a threaded bore in a desired item or material (e.g., a nut, pipe, plate, etc.) are known in the art. These procedures are generally referred to as "tapping" procedures. A byproduct of the tapping process is errant particles (dust, chips, flakes, etc.) of the material that was tapped. These particles may become lodged in the threaded hole and obstruct insertion of a bolt or cause a misthread.

The prior art has devised various methods of removing or extracting these particles. A first includes use of an air pneumatic pressure gun or the like to drive particles out of the cavity. Disadvantageous aspects of this approach include that (1) the pneumatic device is undesirably loud and (2) the use of air pressure to remove particles creates dust which may cause an inhalation problem and increases the likelihood of a particle becoming lodged in a worker's eye, amongst other occupational safety concerns.

Another type of prior art particle extraction device is disclosed in U.S. Pat. No. 5,339,473, issued to Crist on Aug. 23, 1994, for a Tapping Chip Extractor Tool. While this device has a magnetic tip that attracts metallic tapping particles, the device is disadvantageous in that it does not work on non-metallic material, it is limited to one size and it is generally inflexible. The use of inflexible extraction articles increases the possibility of damage to threads, particularly in high tolerance situations.

SUMMARY OF THE INVENTION

Accordingly, it is an object of the present invention to provide a particle extraction device that is applicable to all materials.

It is another object of the present invention to provide a particle extraction device that is flexible to accommodate different size bore holes and different angles of insertion.

It is also an object of the present invention to provide a particle extraction device that positively retains particles extracted from a bore hole.

These and related objects of the present invention are achieved by use of an apparatus for removing debris from a machined or threaded cavity as described herein.

In one embodiment, the present invention includes an apparatus for extracting debris from a machined or threaded cavity that has an extraction member formed at least in part as a flexible coil and a handle member coupled to the coiled extraction member.

The attainment of the foregoing and related advantages and features of the invention should be more readily apparent to those skilled in the art, after review of the following more detailed description of the invention taken together with the drawings.

DETAILED DESCRIPTION

Figure 1:
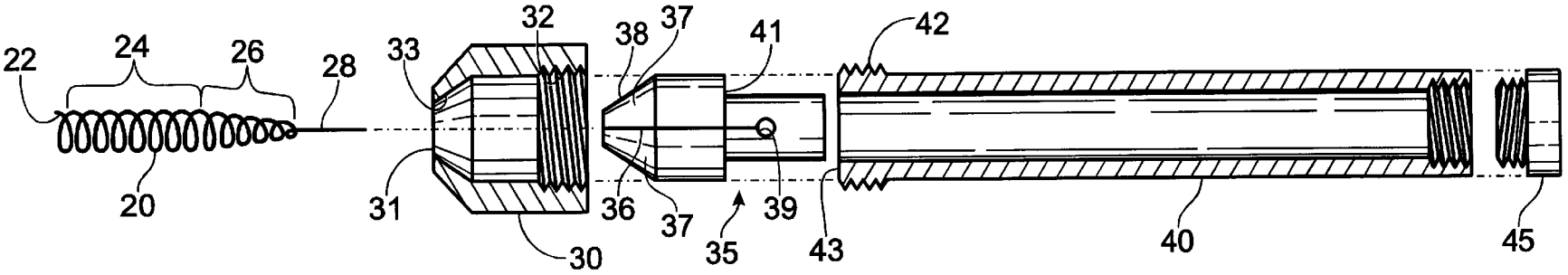
FIG. 1 is an exploded view of a device for extracting debris from a machined cavity in accordance with the present invention.

Referring to FIG. 1, an exploded view of a device for extracting debris from a machined cavity in accordance with the present invention is shown. Extracting device 10 is comprised of a plurality of components including an extraction member 20, a lock nut 30, a collet 35, a hollow shaft 40 and a cap 45. The extraction member is preferably formed of a coil spring wire of sufficient dimensions and sufficient rigidity and elasticity to function as described further herein.

In use, extraction member 20 is inserted through a tip 31 of lock nut 30 into collet 35. The lock nut is screwed onto shaft 40 in such a manner as to cause collet 35 to compress against a mounting shaft of the extraction member such that the extraction member is securely held within the collet. Using hollow shaft 40 as a handle, the extraction mechanism is then inserted into a cavity to-be-cleaned and rotated (preferably counter-clockwise). Amongst other particle extracting features, particles lodged in the threads or elsewhere in a cavity become lodged between the coil loops of the extraction member. The coil loops can be configured at the same slope as the threads in a particular cavity to readily fit into and remove particles therefrom. Since the extraction mechanism is flexible (as a coil spring), various sized particles can become lodged within the coil loops.

In a preferred embodiment, a plurality of extraction members of different size are provided. The plurality of extraction members are preferably stored within hollow shaft 40 when not in use. Multiple size extraction members permit a cleaning of different size holes and a cleaning of different size particles from the same hole.

Having discussed how the various components of extraction device 10 are assembled and used, these individual components are now discussed in more detail.

Extraction member 20 is preferably made of a standard coil spring wire and is heat treated as is known. Extraction member 20 is comprised of several regions and they include an extraction tip 22, coil region 24, tapered region 26 and mounting shaft 28. Extraction tip 22 is effectively a terminus of the coil region 24 and is preferably formed as a straight, angled member (angled at approximately 15 degrees from a plane perpendicular to the extraction member) that can be used to reach into a corner or thread depression or other recess to extract particles. The extraction tip functions in the manner analogous to a finger. Since the extraction member is preferably formed as a variant of a coil spring, the extraction tip has a certain amount of elasticity such that it is flexible enough to conform to variously shaped cavities.

Coil region 24 is similar to a coil spring. As alluded to above, the coil region (and the remainder of the extraction member 20) is formed of a suitable spring wire to provide both appropriate rigidity and elasticity. The spacing of the coil loops may be adjusted to permit various size particles to be lodged therebetween. Examples of preferred coil region diameters for use with various size thread arrangements is provided in Table I below.

TABLE I

Corresponding Thread and Extraction Coil Sizes

| Thread Sizes | | Extractor Coil Diameter |
|---|---|---|
| 2-56 | 4-40 | 1/16" |
| 2-64 | 4-48 | |
| 3-48 | 5-40 | |
| 3-56 | 5-44 | |
| 6-32 | 10-24 | 7/64" |
| 6-40 | 10-32 | |
| 8-32 | 12-24 | |
| 8-36 | 12-28 | |
| 1/4-20 | 5/16-24 | 3/16" |
| 1/4-28 | 3/8-16 | |
| 5/16-18 | 3/8-24 | |
| 7/16-14 | 1/2-20 | 9/32" |
| 1/2-12 | 9/16-12 | |
| 1/2-13 | 9/16-18 | |

Tapered region 26 provides a transition between mounting shaft 28 and coil region 24. Tapered region 26 is sufficiently flexible to permit the coil region 24 to be held at various angles with respect to mounting shaft 28. The coil loops of tapered region 26 also facilitate a lodging of debris within those loops. Mounting shaft 28 is preferably configured as a straight shaft as shown for ready in section into collet 35.

Lock nut 30 preferably contains interior threads 32 that are complementary to exterior threads 42 of hollow shaft 40. Lock nut 30 includes tapered interior walls 33 that apply a force on the exterior walls 38 of collet 35 when threads 32 are screwed onto threads 42. Collet 35 preferably includes a plurality (four in a preferred embodiment) of securing members 37 (two of which are shown) that are separated by slots 36. Collet 35 is shown in more detail in FIG. 2 below and collets of this type are known in the art. Collet 35 may also include an orifice 39 at an end of each slot 36 to permit securing members 37 to pivot slightly about the orifices. This structure provides suitably flexible members 37 that are secured about mounting shaft 28 when the mounting shaft is inserted in a central opening formed at the intersection of slots 36 and the lock nut is screwed on to the hollow shaft such that the interior walls 33 of the lock nut exert a securing force on exterior walls 38 of the collet. Collet 35 has a collar 41 which becomes seated against an end 43 of cylindrical shaft 40.

Cap 45 may be threaded into shaft 40 or simply glued to or otherwise formed with shaft 40.

Figure 2:
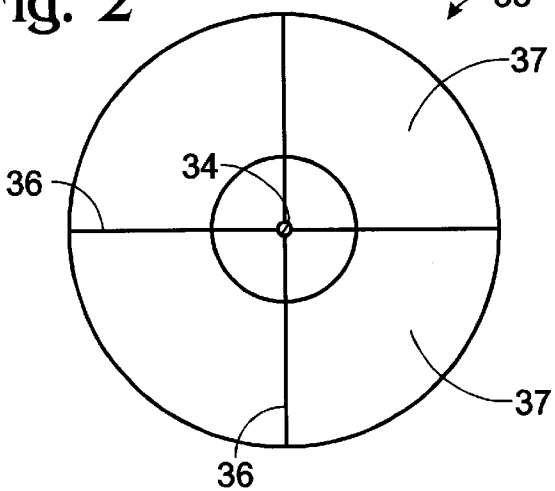
FIG. 2 is a top view of the collet of the debris extracting device of FIG. 1.

Referring to FIG. 2, a top view of collet 35 of FIG. 1 in accordance with the present invention is shown. FIG. 2 illustrates slots 36, flexible members 37, orifices 39 and a central opening 34 into which mounting shaft 28 is inserted.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. An apparatus for extracting debris from a machined or threaded cavity, comprising:

an extraction member having a longitudinal axis and both an extraction end and a mounting end, said extraction end being at least in part coiled; and a handle member having a releasable extraction member holding mechanism provided therewith;

wherein said handle member is configured to define a cavity therein of sufficient size to hold said extraction member when not in use.

2. The apparatus of claim 1, wherein said extraction end of said extraction member has a tip member that is substantially straight and angled from the coil of said extraction end.

3. The apparatus of claim 2, wherein said tip member is disposed approximately 15 degrees out of a plane perpendicular to the longitudinal axis.

4. The apparatus of claim 1, wherein said extraction end of said extraction member has a tip region proximate the coils of said extraction end and said tip region deviates in shape from the coils in such a manner as to facilitate removal of debris in threads or corners of a machined cavity.

5. The apparatus of claim 1, wherein said extraction member is formed of a continuous piece of wire and includes a coil region and a tip region within said extraction end, wherein said mounting end is at least in part straight and substantially parallel with the longitudinal axis of the extraction member, the coil region is provided in the continuous wire between the mounting end and the tip region and the tip region is configured to removal of debris in threads or corners of a machined cavity.

6. The apparatus of claim 5, wherein the coil region is substantially plastic in that it is flexible in response to an applied pressure, but regains its initial shape in the absence of that applied pressure.

7. The apparatus of claim 5, wherein the coil region is flexible to permit the insertion of debris from a machined cavity into the coil loops within the coil region.

8. The apparatus of claim 1, wherein the extraction member is formed of a heat treated coil spring.

9. An apparatus for extracting debris from a machined or threaded cavity, comprising:

an extraction member having an extraction portion and a mounting portion that are disposed along a longitudinal axis, said mounting portion extends from said extraction portion generally along that longitudinal axis, wherein said extraction portion includes a flexible coil having spaced coil loops; and a handle member having a releasable extraction member holding mechanism provided therewith that releasably holds said mounting portion, said releasable extraction member holding mechanism including a collett and a releasable tightener.

10. The apparatus of claim 9, wherein said extraction portion has a tip member that continues from said coil and that is substantially straight and disposed at an angle out of a plane perpendicular to the longitudinal axis of the extraction member.

11. The apparatus of claim 10 wherein said tip member is disposed at an angle of approximately 15 degrees out of said plane.

12. The apparatus of claim 11, wherein said mounting portion of said extraction member is substantially non-coiled.

13. The apparatus of claim 9, wherein said mounting portion is configured to fit into and be releasably secured by said collett and said releasable tightener.

14. The apparatus of claim 9, wherein said extraction portion and said mounting portion are formed of the same continuous, heat treaded wire and said mounting portion is substantially non-coiled.

* * * * *